US007469642B1

(12) United States Patent
LeDoux

(10) Patent No.: US 7,469,642 B1
(45) Date of Patent: Dec. 30, 2008

(54) ADJUSTABLE TABLE AND BASE ASSEMBLY AND METHOD FOR USE

(76) Inventor: John P LeDoux, 5020 Signal Dr., Las Vegas, NV (US) 89130

( * ) Notice: Subject to any disclaimer, the term of this patent is extended or adjusted under 35 U.S.C. 154(b) by 0 days.

(21) Appl. No.: 12/014,617

(22) Filed: Jan. 15, 2008

(51) Int. Cl.
*A47B 9/00* (2006.01)

(52) U.S. Cl. ..... 108/12; 108/157.16; 248/188.1

(58) Field of Classification Search ..... 108/12, 108/11, 91, 93, 158.12, 183, 186, 187, 190, 108/155, 156, 157.16, 159; 248/188, 188.1, 248/188.8
See application file for complete search history.

(56) References Cited

U.S. PATENT DOCUMENTS

| | | | | | |
|---|---|---|---|---|---|
| 800,922 | A | | 10/1905 | Kincaid | |
| 862,791 | A | * | 8/1907 | Bawden | 108/145 |
| 1,227,681 | A | * | 5/1917 | Simms | 108/91 |
| 2,398,693 | A | * | 4/1946 | Bureau | 108/11 |
| 2,611,672 | A | * | 9/1952 | Ohlsson | 248/188 |
| 2,683,014 | A | * | 7/1954 | Sumen et al. | 248/150 |
| 2,956,850 | A | * | 10/1960 | White | 403/65 |
| 2,973,603 | A | * | 3/1961 | De Vincenzo | 108/9 |
| 3,229,790 | A | * | 1/1966 | Shayne | 403/172 |
| 3,291,079 | A | * | 12/1966 | Ruda | 108/156 |
| 3,322,384 | A | * | 5/1967 | Rodwell | 248/188 |
| 3,460,488 | A | | 8/1969 | Hoerner | |
| 3,865,050 | A | * | 2/1975 | Cecchetti | 108/19 |
| 4,303,018 | A | * | 12/1981 | Lehmann | 108/12 |
| 5,096,186 | A | * | 3/1992 | Wilkinson et al. | 482/52 |
| 5,746,139 | A | | 5/1998 | Villanueva | |
| 6,550,402 | B1 | | 4/2003 | Stone et al. | |
| 6,688,239 | B1 | | 2/2004 | Pettini et al. | |

* cited by examiner

*Primary Examiner*—Janet M Wilkens
(74) *Attorney, Agent, or Firm*—Karen J. Sepura; Weiss & Moy, P.C.

(57) ABSTRACT

An adjustable table and base assembly generally comprises a table portion and a base portion. The adjustable table and base assembly may be alternately assembled in a first configuration wherein legs of the table portion are positioned on top of legs of the base portion, or in a second configuration wherein side edges of the legs of the table portion are positioned adjacent side edges of the legs of the base portion. In this way, a user of the adjustable table and base assembly receives a benefit of a single piece of furniture serving multiple purposes. A shelf positioned on the base portion allows a user to store and/or display various articles using the adjustable table and base assembly.

16 Claims, 3 Drawing Sheets

ADJUSTABLE TABLE AND BASE ASSEMBLY AND METHOD FOR USE

FIELD OF THE INVENTION

This invention relates generally to tables and, more particularly, to an adjustable table and base assembly that includes a lower platform for storing and/or displaying various articles, and that may be assembled in alternate configurations, thereby providing for varying heights of the table and base assembly and which may also help facilitate storage of the table and base assembly when not in use.

BACKGROUND OF THE INVENTION

Adjustable tables are well known in the art. Adjustable tables are often particularly useful in areas where space may be limited, such as in the relatively small living quarters that are typical of studio style apartments and college dormitory rooms, or in various other areas of limited space. Some adjustable tables may be alternately configured in a first position wherein the table is of a relatively higher height suitable for dining, and in a second position wherein the height of the table is relatively lower, lending itself to function as a coffee table, for example. In this way, a user may receive the benefit of having a single piece of furniture suit multiple purposes.

A limitation exists with prior art adjustable tables, in that they do not provide storage room for various articles beneath the table tops. Such storage room may be particularly desired by users living in small living quarters, as described above.

A need therefore exists for an adjustable table and base assembly that may be assembled in alternate configurations, thereby providing for varying heights of the table and base assembly, and that includes a lower platform for storing and/or displaying various articles.

The present invention satisfies these needs and provides other, related advantages.

SUMMARY OF THE INVENTION

In accordance with an embodiment of the present invention, an adjustable table and base assembly is disclosed. The adjustable table and base assembly comprises, in combination: a table portion comprising a table top, a plurality of table legs, and horizontal cross bars coupled to the table legs; a base portion comprising a plurality of base legs, horizontal cross bars coupled to the base legs, and a shelf coupled to the cross bars; wherein the table portion may be removably coupled to the base portion alternately in a first configuration wherein the table legs are positioned on top of the base legs, and a second configuration wherein side edges of the table legs are positioned adjacent side edges of the base legs.

In accordance with another embodiment of the present invention, an adjustable table and base assembly is disclosed. The adjustable table and base assembly comprises, in combination: a table portion comprising a table top, a plurality of table legs, a first plurality of holes positioned in the plurality of table legs and adapted to receive a plurality of pegs, a second plurality of holes positioned in an underside of the table top and adapted to receive the plurality of pegs, and horizontal cross bars coupled to the table legs; a base portion comprising a plurality of base legs, a plurality of pegs positioned on the plurality of base legs and adapted to fit alternately in one of the first plurality of holes and second plurality of holes of the table portion, horizontal cross bars coupled to the base legs, and a shelf coupled to the cross bars; wherein the table portion may be removably coupled to the base portion alternately in a first configuration wherein the table legs are positioned on top of the base legs, and a second configuration wherein side edges of the table legs are positioned adjacent side edges of the base legs.

In accordance with a further embodiment of the present invention, a method for using an adjustable table and base assembly is disclosed. The method comprises the steps of: providing an adjustable table and base assembly comprising, in combination: a table portion comprising a table top, a plurality of table legs, a first plurality of holes positioned in the plurality of table legs and adapted to receive a plurality of pegs, a second plurality of holes positioned in an underside of the table top and adapted to receive the plurality of pegs, and horizontal cross bars coupled to the table legs; a base portion comprising a plurality of base legs, a plurality of pegs positioned on the plurality of base legs and adapted to fit alternately in one of the first plurality of holes and second plurality of holes of the table portion, horizontal cross bars coupled to the base legs, and a shelf coupled to the cross bars; wherein the table portion may be removably coupled to the base portion alternately in a first configuration wherein the table legs are positioned on top of the base legs, and a second configuration wherein side edges of the table legs are positioned adjacent side edges of the base legs; assembling the adjustable table and base assembly in one of the first configuration and second configuration; and using the adjustable table and base assembly as a dining table when the adjustable table and base assembly is assembled in the first configuration and using the adjustable table and base assembly as a coffee table when the adjustable table and base assembly is assembled in the second configuration.

DETAILED DESCRIPTION OF THE PREFERRED EMBODIMENTS

Figure 1:
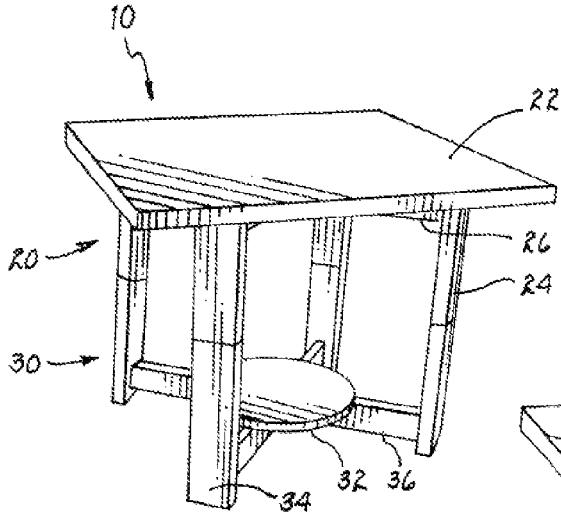
FIG. 1 is a perspective view of an adjustable table and base assembly, consistent with an embodiment of the present invention.

Referring first to FIG. 1, an embodiment of an adjustable table and base assembly 10, consistent with an embodiment of the present invention, is shown. The adjustable table and base assembly 10 generally comprises two principal components: a table portion 20 and a base portion 30 which is removably coupled to the table portion 20.

Figure 3:
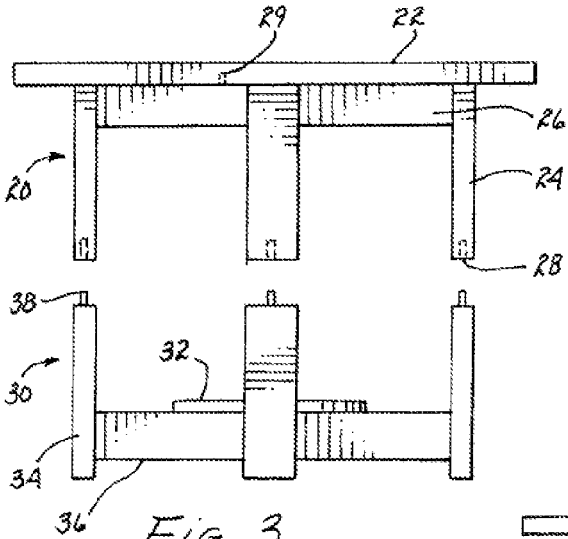
FIG. 3 is a partially exploded, front elevational view of the adjustable table and base assembly of FIG. 1.
Figure 4:
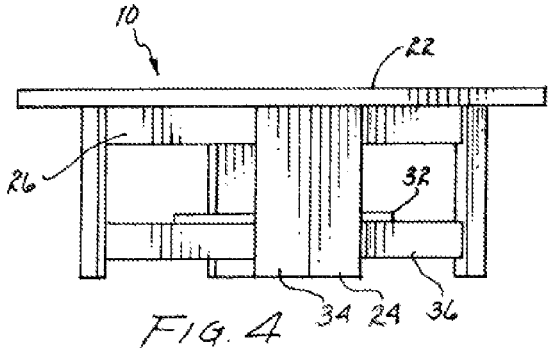
FIG. 4 is a front elevational view of the adjustable table and base assembly of FIG. 2.
Figure 7:
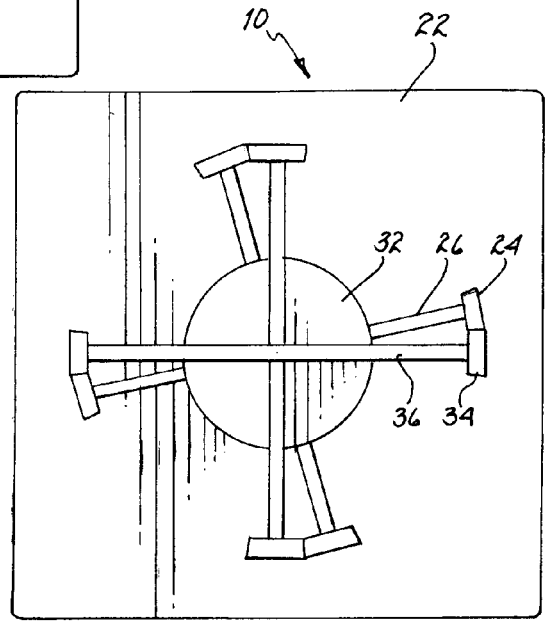
FIG. 7 is a bottom view of the adjustable table and base assembly of FIG. 6, shown in an alternate configuration.
Figure 8:
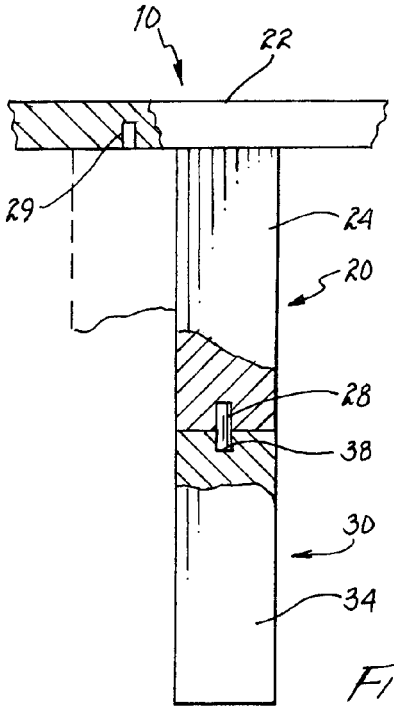
FIG. 8 is a front view of a portion of the adjustable table and base assembly of FIG. 1, showing internal connection points for the table and base.
Figure 9:
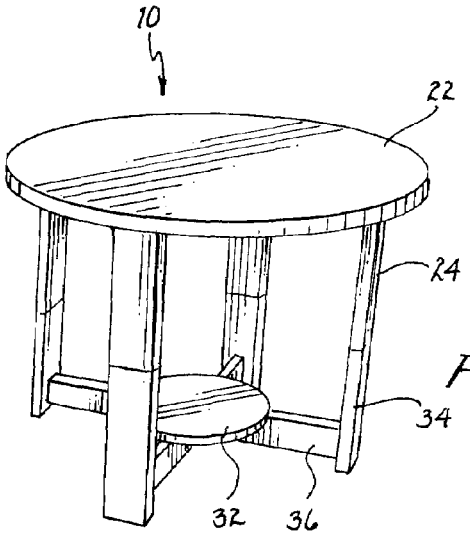
FIG. 9 is a perspective view of an adjustable table and base assembly, consistent with an embodiment of the present invention.
Figure 10:
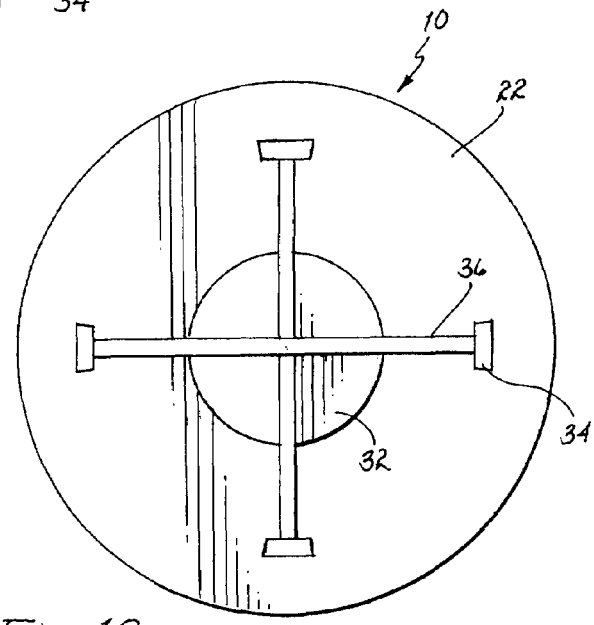
FIG. 10 is a bottom view of the adjustable table and base assembly of FIG. 9.
Figure 11:
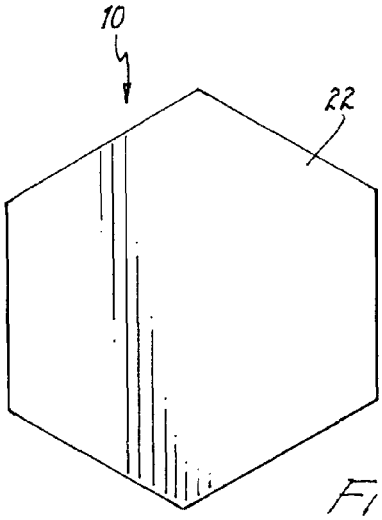
FIG. 11 is a top view of an adjustable table and base assembly, consistent with an embodiment of the present invention.

In this embodiment, the table portion 20 generally comprises a table top 22 and four legs 24. The table portion 20 further includes horizontal crossbars 26 (as best seen in FIGS. 3, 4 and 7), which provide additional stability for the table portion 20. While in this embodiment the table top 22 is square-shaped, the table top 22 may be formed of other shapes, such as a circle (shown in FIGS. 9 and 10), a hexagon (shown in FIG. 11), or virtually any other desired shape. Referring to FIGS. 3 and 8, the table portion 20 also includes connection points, for connecting the base portion 30 to the table portion 20. In this embodiment, the connection points comprise holes 28 and 29, which are adapted to receive corresponding pegs 38 that are preferably situated on the legs 34 of the base portion 30.

Figure 5:
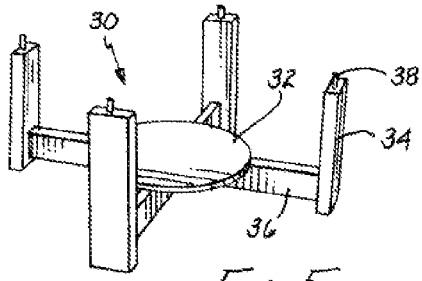
FIG. 5 is a perspective view of a base portion of the adjustable table and base assembly of FIG. 1.

The base portion 30 may be more clearly seen in FIGS. 3 and 5, in particular. In this embodiment, the base portion 30 generally comprises four legs 34, a pair of horizontal cross bars 36, and a shelf 32 coupled to the cross bars 36. The shelf 32 may be used to store and/or display various articles, such as books, magazines, home décor items, or virtually any other types of articles that a user may wish to store or display on the shelf 32. While the shelf 32 in this embodiment is circular, it may be composed of other shapes, as desired. As mentioned above, the base portion 30 further includes pegs 38, for connecting the base portion 30 to the table portion 20. In this embodiment, one of each of the pegs 38 is positioned on top of one of each of the legs 34.

Figure 2:
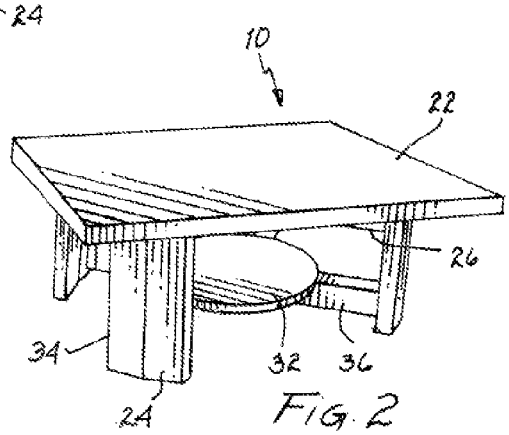
FIG. 2 is a perspective view of the adjustable table and base assembly of FIG. 1, shown in an alternate configuration.
Figure 6:
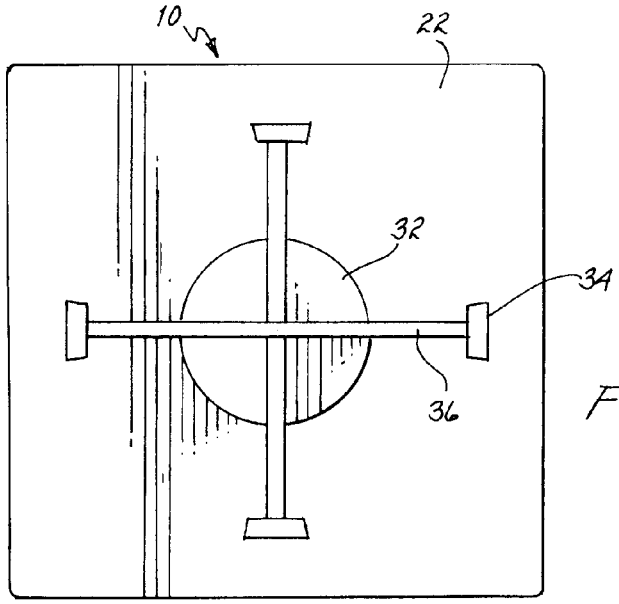
FIG. 6 is a bottom view of an adjustable table and base assembly, consistent with an embodiment of the present invention.

The table portion 20 and base portion 30 are adapted to be mounted together in two different configurations. In a first configuration, as demonstrated in FIGS. 1, 3 and 6, the legs 24 of the table portion 20 are positioned directly on top of the legs 34 of the base portion 30. Preferably, the pegs 38 on the base portion 30 are received by the holes 28 of the table portion 20. In this first configuration, the adjustable table and base assembly 10 is extended to its maximum height, which may be suitable for dining, for example. In a second configuration, as demonstrated in FIGS. 2, 4 and 7, the legs 24 of the table portion 20 and the legs 34 of the base portion 30 are positioned side-by-side. In this second configuration, preferably the pegs 38 on the base portion 30 are received by the holes 29 of the table portion 20. In this second configuration, the adjustable table and base assembly 10 is of a relative minimum height, which may be suitable for use as a coffee table, for example. In order to more securely affix the table portion 20 to the base portion 30 in either the first configuration or the second configuration, it may be desired to incorporate a latch mechanism (not shown) on the legs 24 and 34. A first portion of the latch mechanism may be positioned on each of the legs 24, while a second portion of the latch mechanism may be positioned on each of the legs 34. In this way, once the legs 24 of the table portion 20 are positioned either on top of or side-by-side the legs 34 of the base portion 30, the latch mechanisms may be coupled together, thereby securing the adjustable table and base assembly 10 in the desired configuration.

With respect to materials for the adjustable table and base assembly 10, the adjustable table and base assembly 10 may be composed of any material suitable for furniture, such as wood, fiberboard, acrylic, metal, and the like.

While the invention has been particularly shown and described with reference to preferred embodiments thereof, it will be understood by those skilled in the art that the foregoing and other changes in form and details may be made therein without departing from the spirit and scope of the invention. For example, in order to more securely mount the table portion 20 to the base portion 30 in the first configuration, it may be desired to provide more than one set of holes 28 on each leg 24 of and more than one set of corresponding pegs 38 on each leg 34. Similarly, it may also be desired to provide more than one set of holes 29 proximate each leg 24, for more securely positioning the table and base assembly 10 in the second configuration.

I claim:

1. An adjustable table and base assembly comprising, in combination:

a table portion comprising a table top, a plurality of table legs, and horizontal cross bars coupled to the table legs;

a base portion comprising a plurality of base legs, horizontal cross bars coupled to the base legs, and a shelf coupled to the cross bars;

wherein the table portion may be removably coupled to the base portion alternately in a first configuration wherein the table legs are positioned on top of the base legs, and a second configuration wherein side edges of the table legs are positioned adjacent side edges of the base legs; and a plurality of coupling members adapted to securely couple the table portion to the base portion in the second configuration, wherein the coupling members comprise a plurality of pegs, wherein one peg of the plurality of pegs is positioned on each of the base legs, and a second plurality of holes positioned in an underside of the table top, wherein the second plurality of holes is adapted to receive the plurality of pegs.

2. The adjustable table and base assembly of claim 1 wherein the table top is square-shaped.

3. The adjustable table and base assembly of claim 1 wherein the table top is circular.

4. The adjustable table and base assembly of claim 1 wherein the table top is hexagonal.

5. The adjustable table and base assembly of claim 1 wherein the shelf is circular.

6. The adjustable table and base assembly of claim 1 comprised of one of wood, fiberboard, acrylic, and metal.

7. An adjustable table and base assembly comprising, in combination:

a table portion comprising a table top, a plurality of table legs, a first plurality of holes positioned in the plurality of table legs and adapted to receive a plurality of pegs, a second plurality of holes positioned in an underside of the table top and adapted to receive the plurality of pegs, and horizontal cross bars coupled to the table legs;

a base portion comprising a plurality of base legs, a plurality of pegs positioned on the plurality of base legs and adapted to fit alternately in one of the first plurality of holes and second plurality of holes of the table portion, horizontal cross bars coupled to the base legs, and a shelf coupled to the cross bars;

wherein the table portion may be removably coupled to the base portion alternately in a first configuration wherein the table legs are positioned on top of the base legs, and a second configuration wherein side edges of the table legs are positioned adjacent side edges of the base legs.

8. The adjustable table and base assembly of claim 7 wherein the table top is square-shaped.

9. The adjustable table and base assembly of claim 7 wherein the table top is circular.

10. The adjustable table and base assembly of claim 7 wherein the table top is hexagonal.

11. The adjustable table and base assembly of claim 7 wherein the shelf is circular.

12. The adjustable table and base assembly of claim 7 comprised of one of wood, fiberboard, acrylic, and metal.

13. A method for using an adjustable table and base assembly, comprising the steps of:

providing an adjustable table and base assembly comprising, in combination:

a table portion comprising a table top, a plurality of table legs, a first plurality of holes positioned in the plurality of table legs and adapted to receive a plurality of pegs, a second plurality of holes positioned in an underside of the table top and adapted to receive the plurality of pegs, and horizontal cross bars coupled to the table legs;

a base portion comprising a plurality of base legs, a plurality of pegs positioned on the plurality of base legs and adapted to fit alternately in one of the first plurality of holes and second plurality of holes of the table portion, horizontal cross bars coupled to the base legs, and a shelf coupled to the cross bars;

wherein the table portion may be removably coupled to the base portion alternately in a first configuration wherein the table legs are positioned on top of the base legs, and a second configuration wherein side edges of the table legs are positioned adjacent side edges of the base legs;

assembling the adjustable table and base assembly in one of the first configuration and second configuration; and using the adjustable table and base assembly as a dining table when the adjustable table and base assembly is assembled in the first configuration and using the adjustable table and base assembly as a coffee table when the adjustable table and base assembly is assembled in the second configuration.

14. The method of claim 13 further comprising the step of storing articles on the shelf.

15. The method of claim 13 wherein the shelf is circular.

16. The method of claim 13 wherein the adjustable table and base assembly is comprised of one of wood, fiberboard, acrylic, and metal.

* * * * *